US012352157B2

(12) United States Patent
Janssen et al.

(10) Patent No.: US 12,352,157 B2
(45) Date of Patent: Jul. 8, 2025

(54) IN-RISER TOOL OPERATION MONITORED AND VERIFIED THROUGH ROV

(71) Applicant: FMC Technologies, Inc., Houston, TX (US)

(72) Inventors: Brett Janssen, Houston, TX (US); Blake Schumann, Houston, TX (US); Justin Rodriguez, Houston, TX (US); Matthew Edmiston, Houston, TX (US); Dirk Dunlap, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 18/056,871

(22) Filed: Nov. 18, 2022

(65) Prior Publication Data

US 2024/0167378 A1 May 23, 2024

(51) Int. Cl.

| | |
|---|---|
| ***E21B 47/12*** | (2012.01) |
| ***E21B 17/01*** | (2006.01) |
| ***E21B 33/064*** | (2006.01) |
| ***E21B 47/001*** | (2012.01) |
| ***E21B 47/26*** | (2012.01) |

(52) U.S. Cl.

CPC ..... *E21B 47/12* (2013.01); *E21B 17/01* (2013.01); *E21B 33/064* (2013.01); *E21B 47/001* (2020.05); *E21B 47/26* (2020.05)

(58) Field of Classification Search

CPC ..... E21B 47/12; E21B 47/001; E21B 47/26; E21B 17/01; E21B 33/064

USPC ..... 166/350

See application file for complete search history.

(56) References Cited

U.S. PATENT DOCUMENTS

| | | | | |
|---|---|---|---|---|
| 9,091,153 | B2 | 7/2015 | Yang et al. | |
| 9,103,204 | B2 | 8/2015 | Yates | |
| 9,657,563 | B2 | 5/2017 | Schuhrke et al. | |
| 9,869,174 | B2 | 1/2018 | Szpunar et al. | |
| 10,164,757 | B2 * | 12/2018 | Finch | E21B 41/0007 |
| 10,253,582 | B2 | 4/2019 | DeBerry et al. | |
| 11,075,701 | B2 * | 7/2021 | Rhodes | H04B 13/02 |
| 11,149,544 | B2 | 10/2021 | Deville et al. | |

(Continued)

FOREIGN PATENT DOCUMENTS

| | | | |
|---|---|---|---|
| GB | 2377131 | A | 12/2002 |
| GB | 2481699 | A | 1/2012 |
| WO | 2014011823 | A1 | 1/2014 |

OTHER PUBLICATIONS

International Search Report issued in Application No. PCT/US2023/034613, mailed on Jan. 8, 2024 (6 pages).

(Continued)

*Primary Examiner* — Nicole Coy
*Assistant Examiner* — Douglas S Wood
(74) *Attorney, Agent, or Firm* — Osha Bergman Watanabe & Burton LLP

(57) ABSTRACT

An in-riser communication system includes a riser extending from a surface facility to a subsea wellhead, a communication tool installed on a tool string, wherein the tool string is disposed in the riser, a repeater positioned on an exterior of the riser, a remote operated vehicle (ROV), and a computer system operatively connected to the ROV. When the communication tool and the repeater are positioned in proximity to one another, data is transferred from the communication tool, to the repeater, then to the ROV, and then to the computer system for processing.

17 Claims, 5 Drawing Sheets

(56) References Cited

U.S. PATENT DOCUMENTS

| | | | | |
|---|---|---|---|---|
| 2004/0263158 | A1* | 12/2004 | Biester | G01V 3/081 324/207.26 |
| 2008/0128138 | A1* | 6/2008 | Radi | G06Q 10/087 702/152 |
| 2012/0275274 | A1* | 11/2012 | Gochnour | E21B 47/14 367/134 |
| 2012/0294114 | A1* | 11/2012 | Gochnour | H04B 11/00 166/336 |
| 2013/0038220 | A1* | 2/2013 | Riederer | H05B 41/2928 315/291 |
| 2013/0168081 | A1 | 7/2013 | Yang et al. | |
| 2013/0335232 | A1* | 12/2013 | Conway | H04B 13/02 340/850 |
| 2015/0226054 | A1* | 8/2015 | Schuhrke | E21B 47/14 166/335 |
| 2017/0130562 | A1* | 5/2017 | Jaffrey | E21B 47/001 |
| 2018/0038220 | A1* | 2/2018 | Mourre | E21B 47/0025 |
| 2021/0270129 | A1 | 9/2021 | Moodie et al. | |

OTHER PUBLICATIONS

Written Opinion issued in Application No. PCT/US2023/034613, mailed on Jan. 8, 2024 (9 pages).

* cited by examiner

IN-RISER TOOL OPERATION MONITORED AND VERIFIED THROUGH ROV

BACKGROUND

In subsea well operations, a surface facility may be provided at the surface of the water, which may hold different arrangements of equipment, e.g., drilling equipment such as a rig, drill string equipment, drilling fluid tanks and pumps, etc. and production equipment, depending on the parameters of the operation. A riser may be connected between the surface facility and a wellhead at the sea floor, which may act as a conduit through which a drill string and/or other equipment may be extended from the surface facility to the well. For example, in a typical subsea drilling operation, a riser may be connected between a surface facility (e.g., floating platform or vessel) and a subsea well. A drill string having a bottom hole assembly with a drill bit and other hole opening equipment may be extended from the surface facility, through the riser, and into the subsea well. In the well, the bottom hole assembly may be rotated and operated to drill into the formation to lengthen the well.

Typically, during subsea operations, such operations may be monitored using data collected at the surface facility. For example, different parameters of fluid being returned from the well may be measured at the surface facility, which many indicate different downhole conditions. Examples of such measurements may include fluid temperature and pressure. Additionally, in drilling operations, cuttings returned to the surface facility with spent drilling fluid may be analyzed to monitor drilling operations. For example, different sizes, amounts, and types of rock in the returned cuttings may indicate different formation parameters and/or drilling tool conditions.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to in-riser communication systems that include a riser extending from a surface facility to a subsea wellhead, a communication tool installed on a tool string, wherein the tool string is disposed in the riser, a repeater positioned on an exterior of the riser, wherein the communication tool and the repeater may be positioned in proximity to one another as the tool string moves through the riser, a remote operated vehicle (ROV), and a computer system operatively connected to the ROV.

In another aspect, embodiments disclosed herein relate to methods that include providing a communication tool installed on a tool string in a riser, measuring one or more parameters with one or more sensors disposed in the communication tool, creating a raw data set from the one or more parameters, transmitting the raw data set from the communication tool to a repeater disposed on an exterior surface of the riser, positioning a remotely operated vehicle (ROV) proximate the repeater, transmitting the raw data set from the repeater to the ROV, and transmitting the raw data set from the ROV to a computer system through an umbilical, wherein the computer system is located on a surface facility.

In yet another aspect, embodiments disclosed herein relate to in-riser communication systems including a riser extending from a surface facility to a subsea wellhead, a communication tool installed on an in-riser tool provided in the riser, a repeater positioned on an exterior of the riser, wherein the communication tool and the repeater may be positioned in proximity to one another as the in-riser tool is moved through the riser, a remote operated vehicle (ROV), and a computer system operatively connected to the ROV. The computer system may include a non-transitory computer-readable medium storing instructions, the instructions, when executed on a processor, comprising functionality for receiving raw data from the ROV, converting the raw data into a displayable dataset, transmitting the displayable data set to a display, and displaying the displayable data set on the display to a user.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
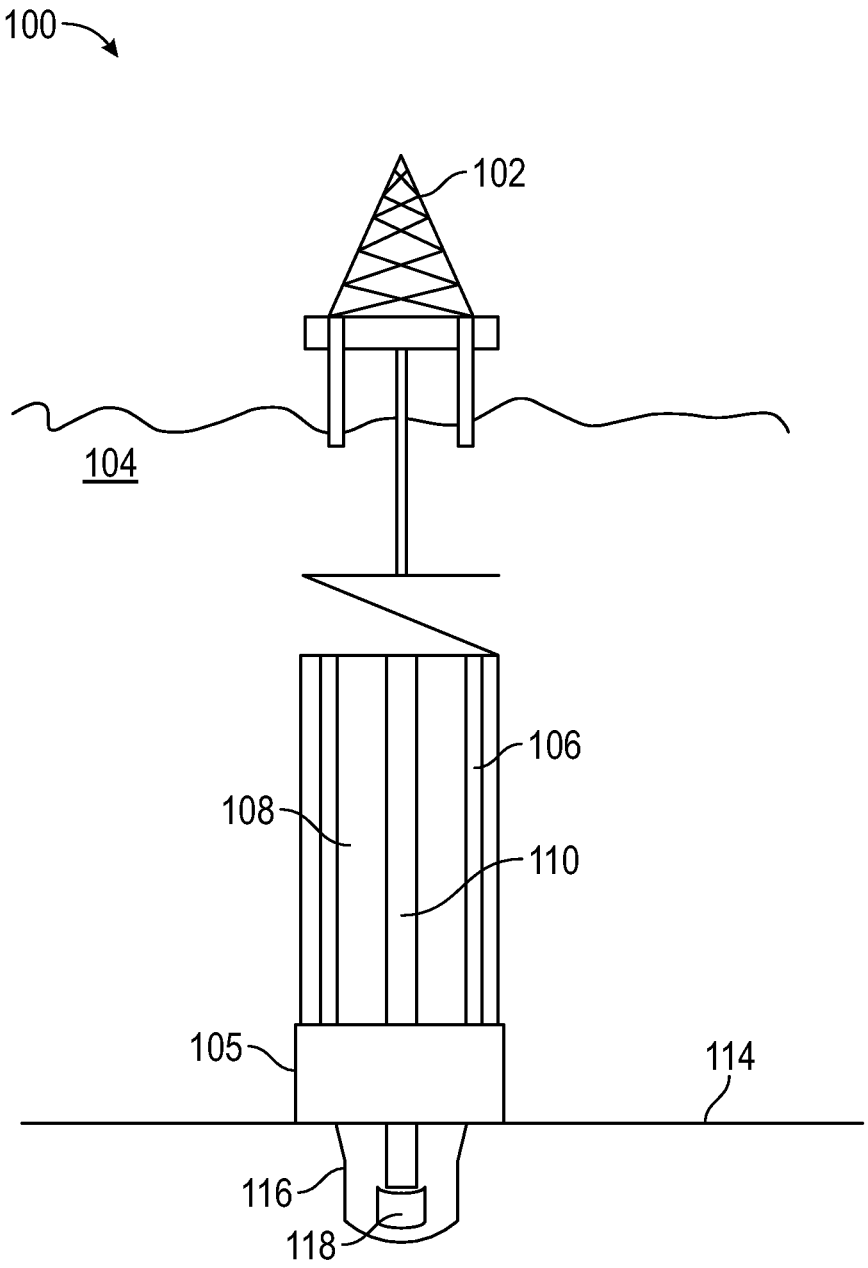
FIG. 1 shows an exemplary off-shore drilling system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-4, any component described with regard to a figure, in various embodiments disclosed herein, may be equivalent to one or more like-named components described with regard to any other figure. For brevity, descriptions of these components may not be repeated for each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

In general, embodiments disclosed herein relate to a communication system employed during wellbore operations, such as during drilling, cementing, fracturing, or other wellbore operations known to those skilled in the relevant art. In one or more embodiments, the wellbore operations may be subsea wellbore operations. Specifically, embodiments disclosed herein relate to an in-riser communication tool designed to transmit data through a riser wall to a repeater unit positioned on an external surface of the riser. In another aspect, embodiments disclosed herein relate to an in-riser communication system designed to measure tool string parameters inside a riser at a given depth below the water level. A tool string may include, for example, a drill string, coiled tubing, or other string of connected-together piping run downhole. The in-riser communication system may transmit the tool string parameter data through the riser wall to a repeater, which may then transmit the tool string parameter data to a remotely operated vehicle (ROV).

FIG. 1 shows a system in accordance with one or more embodiments disclosed herein. The system 100 may be representative of, for example, an offshore hydrocarbons (e.g., petroleum and/or natural gas) recovery operation. The system 100 may include a surface facility 102, a tool string 110, a running tool 118, and a riser 106 and/or blowout preventer (BOP). Each of these components is described below.

In one or more embodiments disclosed herein, the surface facility 102 may be a structure or a maritime vessel that may include functionality to extract, process, and store hydrocarbons that lie beneath the seabed 114. The surface facility 102 may often be positioned directly above the wellbore 116 and, further, be at least partially submerged underwater (e.g., at least a portion of the surface facility 102 resides below the ocean surface 104). In one or more embodiments disclosed herein, a wellbore 116 may be the hole in the seabed 114 produced, by way of drilling, to aid in the exploration and/or recovery of hydrocarbons. One of ordinary skill in the relevant art would appreciate that the surface facility 102 may include additional or alternative functionalities without departing from the scope disclosed herein. Examples of a surface facility 102 include, but are not limited to, an offshore oil platform/rig, an inland barge, a drill ship, a semi-submersible platform/rig, an artificial island, a floating production system (FPSO), a normally unmanned installation (NUI), a satellite platform, etc.

In one or more embodiments disclosed herein, the tool string 110 may be a column, or string, of mostly drill pipe that extends from the surface facility 102 to the wellbore 116. The tool string 110 may further include operational tools, such as a running tool 118 and/or a bottom hole assembly (BHA) (not shown), which may be a collection of components that include, for example, drill collars, drilling stabilizers, downhole motors, rotary steerable systems, a drill bit, and various tools (e.g., measurement while drilling (MWD) and logging while drilling (LWD) tools). Further, the tool string 110 may be hollow, thereby enabling the pumping and/or circulation of fluids (e.g., water, compressed air, polymers, water or oil based mud, etc.) from the surface facility 102 to the wellbore 116. The aforementioned fluids may be applied to facilitate the wellbore operation. The tool string 110 may include further functionality to propagate torque to the running tool 118 or for operating a drill bit at the bottom of the wellbore 116.

The running tool 118 may be specialized equipment that is used in a variety of operations throughout the wellbore operation. The various operations for which the running tool 118 may be used include, but are not limited to, fishing, casing, cementing, well-bottom communication, drilling, logging, well measurement, part installation/retrieval, and fracturing. The running tool 118 may include one or more sensor(s) (not shown). A sensor may refer to hardware, software, firmware, or any combination thereof, which may include the functionality to detect and measure one or more physical properties (e.g., heat, light, sound, pressure, motion, etc.) or other measurements that may be taken during wellbore operations (e.g., such as tools and/or sensors as may be associated measurement while drilling (MWD) tools, etc.). Examples of a sensor include, but are not limited to, an accelerometer, a pressure sensor, a temperature sensor, a microphone, a camera, a light detector, a fiber optic sensor, gyroscope, stress/strain gauge, etc. The running tool 118 may also include one or more actuator(s) (not shown). An actuator may be an electrical, piezoelectric, electro-mechanical, mechanical, magnetic, or hydraulic device or mechanism. In addition, an actuator may include functionality to generate stimuli to facilitate the wellbore operation—the nature of which may be kinetic, sensory, thermal, chemical, nuclear, or any other type of stimulus. Examples of an actuator include, but are not limited to, a motor, a fluidic pump, a piezoelectric element, a hydraulic cylinder, a solenoid, a valve, etc. One of ordinary skill in the relevant art would appreciate that the running tool 118 may include further functionalities and/or components without departing from the scope disclosed herein.

The riser 106 may be a conduit for the transportation of hydrocarbons and/or mud (e.g., the fluid column 108) from the wellbore 116 to the surface facility 102. The riser 106 may include further functionality to transport production materials (e.g., injection fluids, control fluids, etc.) from the surface facility 102 to the wellbore 116. The riser 106 may envelope the tool string 110 and running tool 118, and thereby temporarily extend the wellbore 116 from the wellhead to the surface facility 102. The riser 106 may also be insulated in order to withstand seabed 114 temperatures and can either be rigid or flexible. The riser 106 may be one of numerous existing or later developed riser types, examples of which include, but are not limited to, an attached riser, a pull tube riser, a steel catenary riser, top-tensioned riser, a riser tower, a flexible riser, and a drilling riser.

The riser 106 may be used with a blowout preventer (BOP) 105, which may include a specialized valve or similar mechanical device that may include functionality to seal, control, and monitor the wellbore 116 to prevent a blowout. A blowout may refer to the uncontrolled release of hydrocarbons (e.g., crude petroleum and/or natural gas) from the wellbore 116. The BOP 105 may be secured to the top of the wellbore 116, and the riser 106 may extend from the BOP 105 to the surface facility 102. Examples of a BOP include, but are not limited to, a ram-type BOP and an annular-type BOP.

Figure 2A:
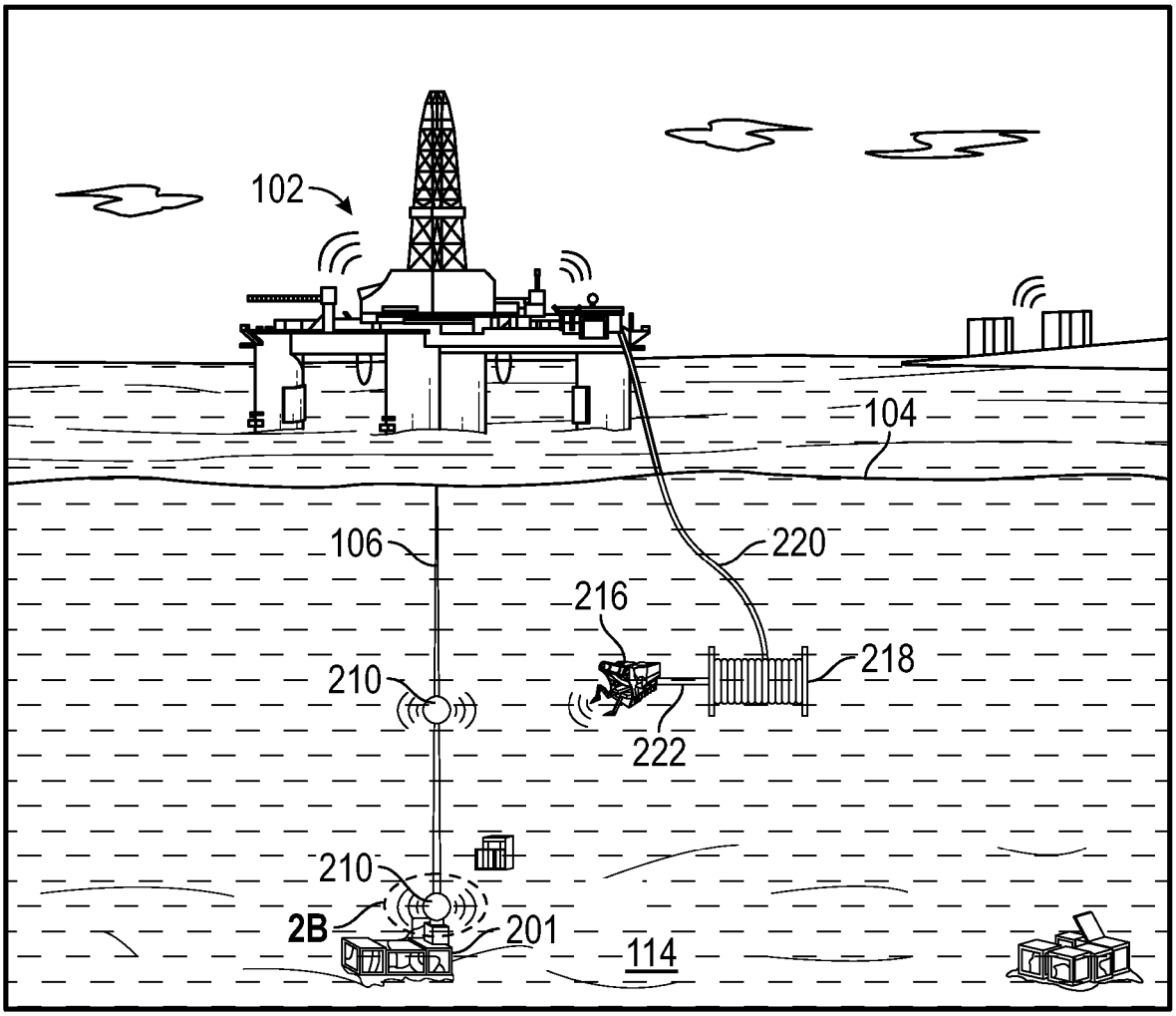
FIGS. 2A and 2B show an in-riser communication system in accordance with one or more embodiments.
Figure 2B:
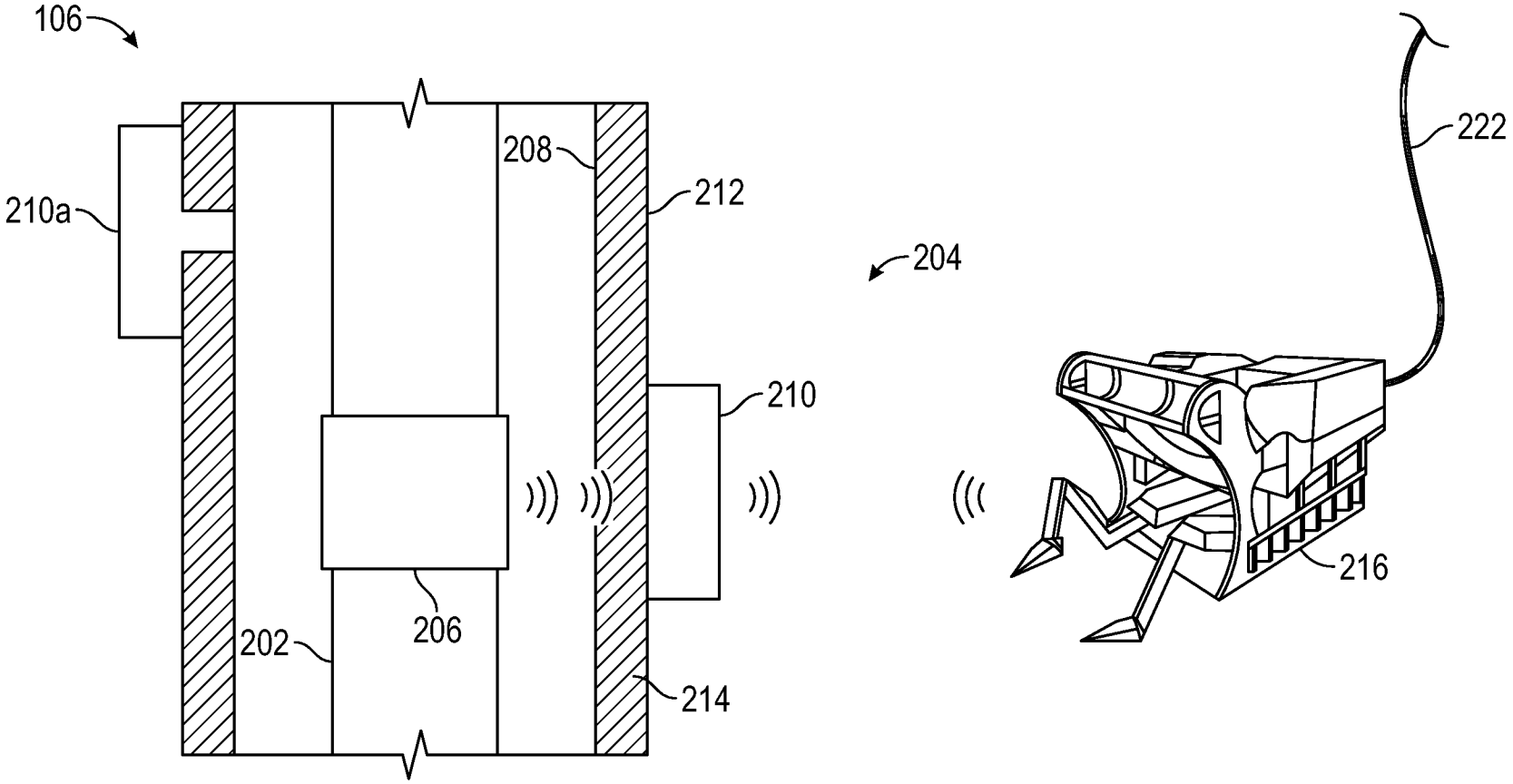

FIGS. 2A-B shows an in-riser communication system in accordance with one or more embodiments. A surface facility 102 may be located above the ocean surface 104. In one or more embodiments, the surface facility 102 may be a drilling platform or any other floating structure positioned laterally above a subsea well and used for subsea well production operations.

A riser 106 may extend from the surface facility 102 to a subsea wellhead 201. The wellhead 201 may include valves, manifolds, a BOP stack, and other equipment that may be used to control the flow of fluids in and out of the well. One or more in-riser tools 202 may be provided throughout the length of the riser 106. An in-riser tool 202 may include tools that are run through the riser 106 for various wellbore operations, for example, tool strings 110 and various equipment provided on a tool string. In one or more embodiments, an in-riser communication system 204, which is shown in greater detail in FIG. 2B, may be provided with the riser 106 and in-riser tool 202.

Turning now to FIG. 2B, FIG. 2B shows the in-riser communication system 204 positioned at a depth along the riser 106. The in-riser communication system 204 may include a communication tool 206 positioned on an in-riser tool 202, and a repeater 210 positioned on an exterior surface 212 of the riser 106. The repeater 210 may be installed on the exterior surface 212 of the riser 106 either before or after the riser is installed between the surface facility and the wellhead. In some embodiments, the repeater 210 may be installed on the exterior surface 212 of the riser using one or more fasteners, clamps, or welding to connect the entire repeater 210 device outside the riser at a selected location along the riser 106. In such embodiments, when a communication tool 206 is proximate the repeater 210, signals sent from the communication tool 206 may travel through the riser wall 214 to the repeater 210.

In some embodiments, such as shown by repeater 210*a*, the repeater 210*a* may be installed on the exterior surface 212 of the riser by punching a receiving portion of the repeater 210 through the riser wall 214, such that the receiving portion extends from the interior surface 208 of the riser wall to the exterior surface 212 of the riser wall, and where the remaining portion of the repeater 210 is outside the riser 106. In such embodiments, when a communication tool is proximate the repeater 210*a*, signals sent from the communication tool 206 may travel to the receiving portion of the repeater 210*a*, thereby allowing the repeater 210*a* to receive signals without traveling through the riser wall 214. In one or more embodiments, when a repeater 210*a* includes a receiving portion that extends through the riser wall 214, one or more sealing elements may be provided between the riser 106 and the repeater 210*a* to prevent or inhibit fluid leaks into or out of the riser 106.

Different installation techniques may be used to connect a communication tool 206 to an in-riser tool 202 depending on the type of in-riser tool. For example, in some embodiments, when connecting a communication tool 206 with a tool string, such as shown in FIG. 2B, the communication tool 206 may be provided in a pipe segment configuration, having threaded opposite axial ends and one or more sensors, where the threaded opposite axial ends may be connected in-line with the tool string in an end-to-end fashion.

As the tool string 110 and connected communication tool 206 is extended through the riser 106, the communication tool 206 may pass by the repeater 210, such that the communication tool 206 and the repeater 210 are positioned at a shared axial position along the wall 214 of the riser 106 for a time. In other words, as the communication tool 206 on an in-riser tool reaches the repeater 210, both the communication tool 206 and the repeater 210 are located at the same depth beneath the ocean surface 104. As the communication tool 206 passes within proximity of the repeater 210, data may be transferred from the communication tool 206 to the repeater 210. In one or more embodiments, multiple communication tools 206 may be provided along an in-riser tool, and/or multiple repeaters 210 may be provided along the exterior surface 212 of the riser 106. In such embodiments, more data points may be collected as the in-riser tool moves through the riser 106.

In one or more embodiments, a repeater 210 may be positioned on the riser proximate a blowout preventer, BOP (not pictured). In some embodiments, a repeater 210 may be positioned on a BOP. In such embodiments, when communication tool(s) 206 installed along an in-riser tool approach the repeater 210, the communication tool(s) 206 may send data to the repeater 210 indicating which in-riser tool is approaching the BOP and/or other in-riser tool parameters, such as location data. Such data may be helpful for making BOP operational decisions, for example.

In one or more embodiments, the communication tool 206 may include one or more sensors, each sensor configured to measure a different in-riser parameter. For example, the communication tool 206 may include a plurality of sensors to measure location and/or directional data of the connected in-riser tool, such as heading, depth, number of turns, inclination, acceleration, weight on the in-riser tool, and pressure. A sensor monitoring a given in-riser parameter measures such in-riser parameter at the location of the sensor. For example, a communication tool 206 positioned at a first location along an in-riser tool may include one or more sensors for monitoring an in-riser parameter at the first location as the in-riser tool is moved through the riser. For example, a communication tool 206 positioned at a first location along the riser may include a position sensor, which may measure one or more of the depth of the first location, the acceleration of the in-riser tool at the first location as it sways/moves through the riser, the heading of the first location (e.g., which cardinal direction the first location is facing), and/or other position measurements. Communication tool(s) 206 may be installed along an in-riser tool such that the communication tool 206 stays in the same location along the in-riser tool and moves with the in-riser tool as the in-riser tool is moved through the riser. Location and/or directional data collected from the communication tool(s) 206 may indicate the position and/or movement of the in-riser tool relative to the riser, which may be used to determine position and/or movement of connected tools through the well.

The communication tool 206 may compile the sensor measurements into a raw data set. The communication tool 206 may then transmit the raw data set through the riser wall 214 to the repeater 210. In one or more embodiments, transmission through the riser wall 214 may be achieved via acoustic or electromagnetic communication, for example.

An ROV 216 may be positioned proximate the repeater 210. The repeater 210 may transmit the raw data set to the ROV 216. In one or more embodiments, transmission of the raw data set from the repeater 210 to the ROV 216 may be accomplished via acoustic, electromagnetic, or optical communication, for example.

In one or more embodiments, the ROV 216 may include a detachable tool interface, wherein the detachable tool interface is connected to one or more removeable pucks. The one or more removable pucks may each perform different functions. For example, one of the removable pucks may be configured to transmit data from the repeater 210 to the ROV 216. In these embodiments, the repeater may also include a detachable tool interface configured to connect to a removable puck. When the removable puck is connected to the interface of the repeater, the data stream from the repeater may be constantly sent through the ROV (e.g., through wet mate fiber optic and electrical connectors) in substantially real time (e.g., with a time lag of fractions of a second).

Turning back to FIG. 2A, the ROV 216 may be connected to a tether management system (TMS) 218 via a tether cable 222, and the TMS 218 may be connected to the surface facility 102 via an umbilical 220. In one or more embodiments, the umbilical 220, the tether management system 218, and the tether cable 222 in combination may be a transmission route which connects the ROV 216 to a computer system located on the surface facility 102. The umbilical 220 may coil around the tether management system 218, such that the umbilical 220 may be shortened or lengthened to raise or lower the TMS 218 to different depths, e.g., to move the TMS 218 to a depth proximate the depth of the repeater 210. The TMS 218 may be connected to a computer system (not pictured) located on the surface facility 102 via the umbilical 220. In one or more embodiments, a TMS 218 may hang in the water from the surface facility and be located close to the operating depth and location of the ROV. Additionally, the TMS 218 may include a tether cable 222, which may tether the ROV 216 to the TMS 218. In one or more embodiments, after the TMS 218 is deployed close to or at the depth of the repeater 210 via the umbilical 220, the ROV 216 may be deployed to various distances in a generally horizontal direction from the TMS 218 via the tether cable 222.

Figure 3:
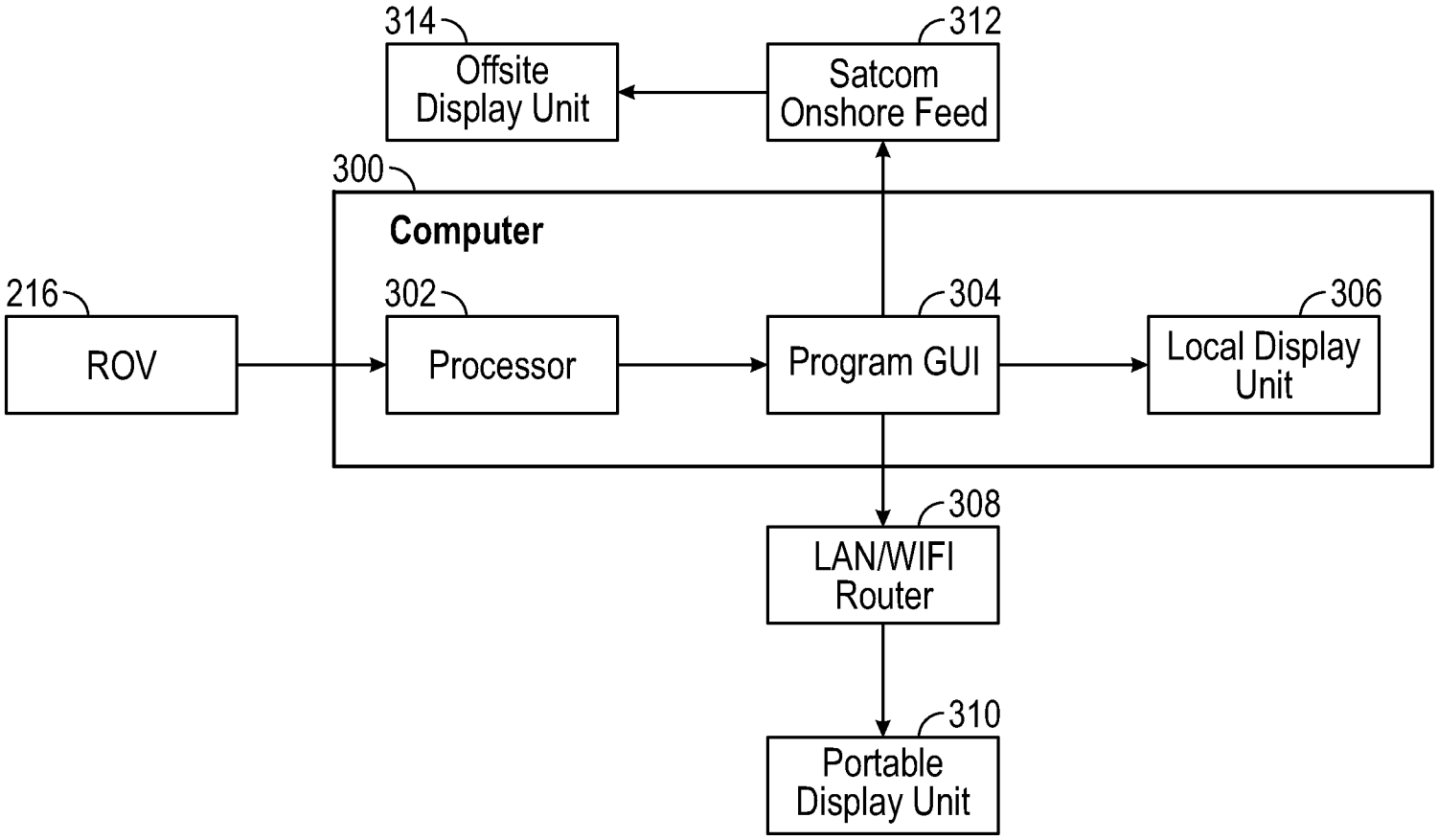
FIG. 3 shows a communication system in accordance with one or more embodiments.

Turning now to FIG. 3, FIG. 3 shows a communication system in accordance with one or more embodiments. More specifically, FIG. 3 shows a computer system 300 operatively connected to an ROV 216 via, for example, an umbilical 220, a tether management system 218 and a tether cable 222, as shown in FIG. 2A. In one or more embodiments, the computer system 300 may be located on a surface facility, such as surface facility 102 shown in FIGS. 1 and 2A.

In one or more embodiments, the computer system 300 may include a processor 302 and a program GUI 304 (graphic user interface). The computer system 300 may also include a memory (e.g., random access memory (RAM), various types of short-term memory, various types of long-term memory, and other types of memory storage known in the art). According to embodiments of the present disclosure, a communication system may include one or more computer systems 300. Additionally, a computer system 300 may include more than one processor 302, more than one GUIs, and/or multiple other computer components know in the art.

The processor 302 may receive the raw data set from the ROV 216. In one or more embodiments, the processor 302 may run a variety of algorithms on the raw data set. Further, the processor 302 may be configured to convert the raw data set into a displayable format, which may include, but is not limited to, graphs.

The program GUI 304 may be connected to a local display unit 306 which may visually display the displayable format of the raw data set. In one or more embodiments, the local display unit 306 may be located on the surface facility 102, and may include one or more monitors, each configured to visually display one or more of the riser parameters measured by the communication tool 206, pictured in FIG. 2B.

The program GUI 304 may also be connected to a LAN/WIFI router 308, which may transmit data from the program GUI 304 to a portable display unit 310 via a wireless network. The portable display unit 310 may be, for example, a tablet. The program GUI 304 may further be connected to a satellite communications (SATCOM) onshore feed 312, which may be configured to transmit data from the program GUI 304 to an offsite display unit 314. The offsite display unit 314 may, for example, be located at an onshore facility.

In one or more embodiments, the processor 302 may also run algorithms to identify any unreliable or otherwise undesirable data points. The program GUI 304 may then generate a user display message, which may be displayed on the local display unit 306, the portable display unit 310 and/or the offsite display unit 314. For example, if a sensor in a communication tool 206 measures a pressure above a set maximum value, the program GUI 304 may generate a user display message of a high-pressure warning.

In one or more embodiments, the computer system 300 may include a non-transitory computer-readable medium storing instructions, the instructions, when executed on the processor 302, including functionality for receiving the raw data set from the ROV 216 via the TMS 218 and converting the raw data set into a displayable data set. The instructions may also include functionality for transmitting the displayable data set to a display, such as the local display unit 306, the portable display unit 310 and/or the offsite display unit 314.

Figure 4:
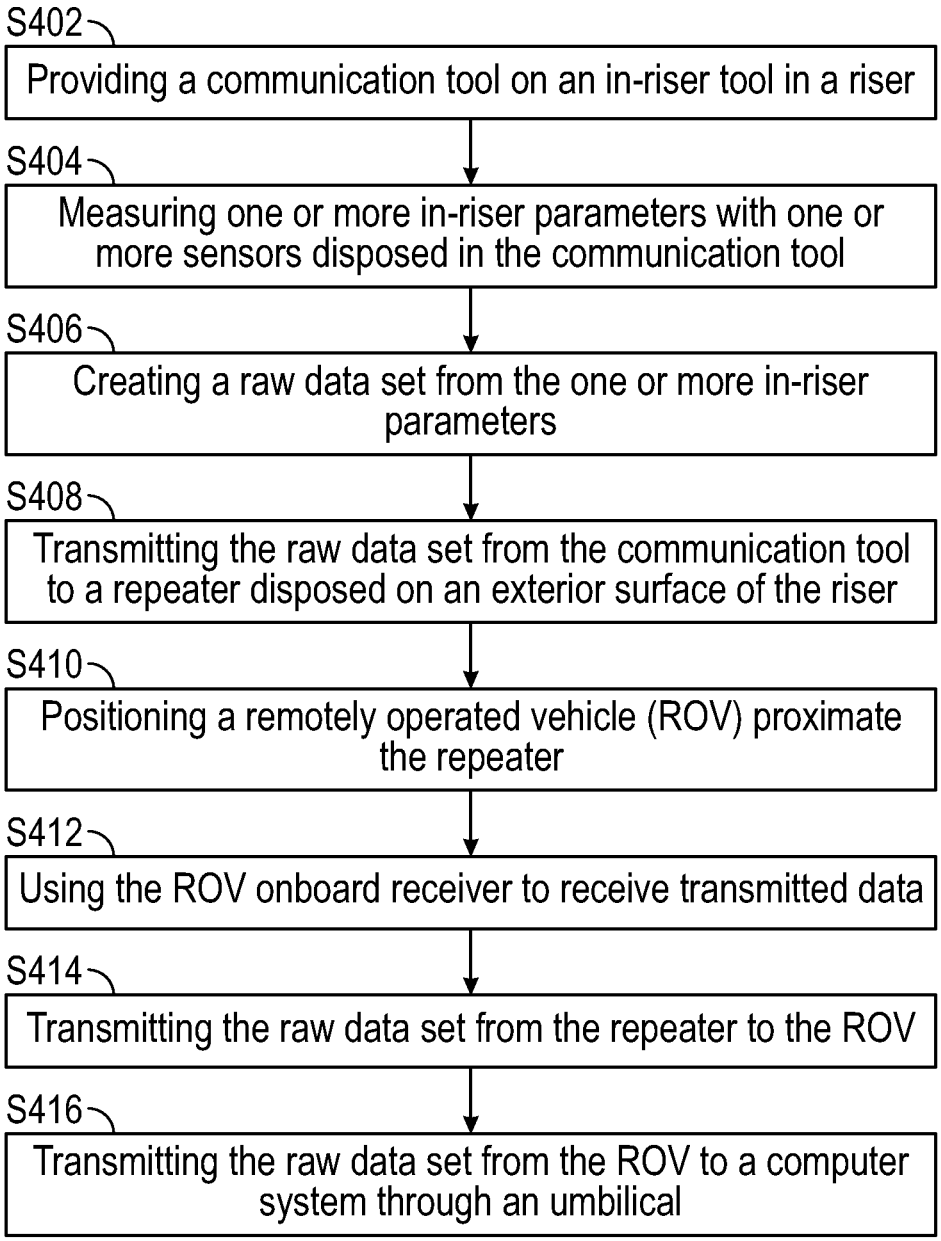
FIG. 4 shows a flowchart of a method in accordance with one or more embodiments.

FIG. 4 depicts a flowchart in accordance with one or more embodiments. More specifically, FIG. 4 depicts a flowchart 400 of a method of transmitting data from an in-riser communication system to a computer system. Further, one or more blocks in FIG. 4 may be performed by one or more components as described in FIGS. 1-3. While the various blocks in FIG. 4 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

Initially, a communication tool 206 may be provided on an in-riser tool 202 in a riser 106, S402. For example, in one or more embodiments, the communication tool 206 may be positioned on a tool string 110. The tool string 110 may transport the communication tool 206 through a riser 106. The communication tool 206 may include one or more sensors, each configured to measure one or more in-riser parameters, S404, such that location and/or directional data of the connected in-riser tool. The communication tool 206 may also compile the measurements taken by the one or more sensors and may create a raw data set from the one or more in-riser parameters, S406.

The raw data set may be transmitted from the communication tool 206 to a repeater 210 secured to an exterior surface 212 of the riser 106, S408. According to embodiments of the present disclosure, a repeater 210 may be mechanically installed to a riser, a BOP, a wellhead or other installed structure that is within the communication envelope of the communication system being used. In some embodiments, a repeater may be positioned, installed and/or removed by an ROV. In one or more embodiments, transmission of the raw data set may be accomplished via acoustic or electromagnetic transmission, for example. However, transmission of the raw data set may also be accomplished by other communication methods without departing from the scope of this disclosure.

An ROV 216 may be positioned proximate the repeater 210, S410. In one or more embodiments, the ROV 216 may be tethered to a tether management system 218 via tether cable 222. According to user input and the depth of the repeater 210, the ROV 216 may be positioned by pilot control to raise or lower the ROV 216 as needed to a position proximate to or contacting the repeater 210. The ROV 216 may include an onboard receiver which may be set to receive transmitted data, S412.

The raw data set may be transmitted from the repeater 210 to the ROV 216, S414. The ROV 216 may be moved to a position proximate to or contacting the repeater 210 depending on the type of data transmission between the repeater 210 and the ROV. For example, in one or more embodiments, data transmission may be accomplished via acoustic transmission. In such embodiments, an ROV may be positioned within or around 500 ft of the repeater 210 to receive data transmission. In other embodiments, data transmission may be accomplished via optical transmission when the ROV 216 is positioned directly next to the repeater 210.

In one or more embodiments, an ROV may be positioned in station keep (in a maintained positioned) next to or proximate a repeater continuously in order to provide real time and continuous flow of data from the repeater to the surface facility.

The raw data set may then be transmitted from the ROV 216 to a computer system 300 through the umbilical 220, S416. In one or more embodiments, the computer system 300 may process the raw data set and run a variety of algorithms, such that the raw data set is converted into a displayable format, which may also be referred to as a displayable data set. In one or more embodiments, this may include plotting the raw data set on one or more graphs. In some embodiments, this may include displaying a numerical value, e.g., a current pressure value and/or a current temperature at the sensor location from which the raw data originated. Further, running algorithms may also include identifying undesirable data points and generating a message to be displayed to a user indicating the undesirable data points. In one or more embodiments, the message may be a status message or a warning message.

In one or more embodiments, the method displayed in flowchart 400 may further include displaying the displayable format on a display unit connected to the computer system 300. In one or more embodiments, the display unit may be located on the surface facility, such as the local display unit 306 positioned on the surface facility 102. In other embodiments, the display unit may be a portable display unit 310, such as a tablet, which is wirelessly connected to the computer system 300. In yet other embodiments, the display unit may be an offsite display unit 314, which may be connected to the computer system 300 via satellite communications systems.

In one or more embodiments, the method depicted in flowchart 400 may be repeated continuously in order to transmit real time data from the in-riser communication tool 206. Such real time transmission may allow for a user to determine real time changes in the one or more riser parameters.

Embodiments of the present disclosure may provide at least one of the following advantages. Current systems require measurement of in-riser tool parameters from the surface facility. However, measurements taken at the surface facility are generally inaccurate and unrepresentative of measurements which would be taken at a desired depth. Embodiments of the present disclosure may allow for measurement of in-riser tool parameters, e.g., location and/or directional data of an in-riser tool such as a tool string or running tool, within the riser, at a desired depth. Embodiments of the present disclosure also allow for wireless transmission of in-riser tool parameter data from a communication tool installed on the in-riser tool and located inside the riser to a repeater located on the exterior of the riser, before further wireless transmission to an ROV. Transmission of data may be accomplished in real time, such that up-to-date data may be displayed to users, both locally on the surface facility, and onshore at offsite facilities.

Therefore, the systems and methods disclosed herein may allow for more accurate measurements and real time data transmission to allow up to date monitoring and adjustment of systems. In contrast, commercially available systems allow only for monitoring and assessment of historical data, rather than real time data.

Additionally, systems and methods according to embodiments of the present disclosure may allow for a monitoring party to monitor in-riser parameters for third-party tools. For example, one or more communication tools according to embodiments of the present disclosure may be installed above/below a third-party tool on a tool string (e.g., a tool owned or operated by a company different from the party monitoring the in-riser tool parameters). Additionally, one or more repeaters may be installed along an exterior of the riser according to embodiments of the present disclosure. After the communication tool(s) in the tool string and repeater(s) are installed along the riser, the monitoring party may use an ROV to collect raw in-riser parameter data that is passed through the wall of the riser, from the communication tool(s) to the repeater(s). The in-riser parameter data may then be sent from the ROV to a surface location, where it may be processed and analyzed to provide a displayable data set about the in-riser tool to the third party owning or operating the in-riser tool. In such manner, the monitoring party may be able to provide tool string monitoring services to third parties for various in-riser tooling systems without significant upfront monitoring set-up costs or assembly operations for the third parties.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. An in-riser communication system, comprising:

a riser extending from a surface facility to a subsea wellhead;

a communication tool comprising one or more sensors installed on a tool string, wherein the tool string is disposed in the riser, wherein the one or more sensors are configured to measure one or more parameters selected from the group consisting of turns in the tool string, inclination of the tool string, heading, and weight on the tool string at a depth of the communication tool within the riser;

a repeater positioned on an exterior surface of the riser, the repeater comprising a body, a first end, and a second end, wherein the body penetrates a wall of the riser with the first end exposed on an inner surface of the riser and the second end exposed on an outer surface of the riser;

wherein the communication tool and the repeater are positioned in proximity to one another, and wherein the communication tool is configured to transmit data to the repeater;

a remote operated vehicle (ROV); and a computer system operatively connected to the ROV, wherein the computer system comprises a computer processor and a memory.

2. The in-riser communication system of claim 1, further comprising a user display unit connected to the computer system, wherein the user display unit is configured to display real time data.

3. The in-riser communication system of claim 1, wherein the computer system is positioned on the surface facility.

4. The in-riser communication system of claim 1, wherein the communication tool and the repeater are positioned proximate a blowout preventer on the subsea wellhead.

5. The in-riser communication system of claim 1, wherein the ROV comprises a detachable tool interface, wherein the detachable tool interface is connected to a removeable puck.

6. The in-riser communication system of claim 5, wherein the repeater comprises a tool puck interface configured to connect to the removeable puck.

7. A method, comprising:

providing a communication tool comprising one or more sensors in a riser, wherein the communication tool is installed on a tool string, and wherein the one or more sensors are configured to measure one or more parameters selected from the group consisting of turns in the tool string, inclination of the tool string, heading, and weight on the tool string at a depth of the communication tool within the riser;

measuring the one or more parameters with the one or more sensors disposed in the communication tool;

creating a raw data set from the one or more parameters;

transmitting the raw data set from the communication tool to a repeater positioned on an exterior surface of the riser, the repeater comprising a body, a first end, and a second end, wherein the body penetrates a wall of the riser with the first end exposed on an inner surface of the riser and the second end exposed on an outer surface of the riser;

positioning a remotely operated vehicle (ROV) proximate the repeater;

transmitting the raw data set from the repeater to the ROV; and transmitting the raw data set from the ROV to a computer system through an umbilical, wherein the computer system is located on a surface facility and comprises a computer processor and a memory.

8. The method of claim 7, further comprising:

plotting the raw data set into one or more graphs; and displaying the one or more graphs on a display unit connected to the computer system.

9. The method of claim 7, wherein the ROV is connected to a Tether Management System (TMS) by a tether cable and the TMS is connected to the computer system via the umbilical.

10. The method of claim 7, wherein the method is repeated continuously to determine real time changes in the one or more parameters.

11. The method of claim 7, further comprising:

running one or more algorithms on the raw data set;

identifying one or more undesirable data points; and displaying a user message indicating the one or more undesirable data points on a display unit connected to the computer system.

12. The method of claim 7, wherein a display unit is wirelessly connected to the computer system and where the display unit is positioned at an onshore location.

13. The method of claim 7, wherein transmitting the raw data set from the communication tool to the repeater comprises transmitting data via acoustic or electromagnetic transmission.

14. The method of claim 7, wherein transmitting the raw data set from the repeater to the ROV comprises acoustic or optical transmission.

15. An in-riser communication system, comprising:

a riser extending from a surface facility to a subsea wellhead;

a communication tool comprising one or more sensors installed on an in-riser tool provided in the riser, wherein the one or more sensors are configured to measure one or more parameters selected from the group consisting of turns in the in-riser tool, inclination of the in-riser tool, heading, and weight on the in-riser tool at a depth of the communication tool within the riser;

a repeater positioned on an exterior surface of the riser, the repeater comprising a body, a first end, and a second end, wherein the body penetrates a wall of the riser with the first end exposed on an inner surface of the riser and the second end exposed on an outer surface of the riser, wherein the communication tool and the repeater are positioned in proximity to one another, and wherein the communication tool is configured to transmit data to the repeater;

a remote operated vehicle (ROV); and a computer system operatively connected to the ROV, wherein the computer system comprises a non-transitory computer-readable medium storing instructions, the instructions, when executed on a processor, comprising functionality for:

receiving raw data from the ROV;

converting the raw data into a displayable data set;

transmitting the displayable data set to a display; and displaying the displayable data set on the display to a user.

16. The in-riser communication system of claim 15, the instructions comprising further functionality for:

transmitting the displayable data set to a portable display unit via a wireless connection; and displaying the displayable data set on the portable display unit.

17. The in-riser communication system of claim 15, wherein the ROV is connected to the computer system via an umbilical.

* * * * *